US005328330A

United States Patent [19]

Monroe

[11] Patent Number: 5,328,330

[45] Date of Patent: Jul. 12, 1994

[54] EXTRUDED ALUMINUM FAN BLADE

[75] Inventor: Robert C. Monroe, Houston, Tex.

[73] Assignee: Hudson Products Corporation, Houston, Tex.

[21] Appl. No.: 100,847

[22] Filed: Aug. 2, 1993

[51] Int. Cl.[5] ..... F04D 29/38

[52] U.S. Cl. ..... 416/62; 416/231 B

[58] Field of Search ..... 416/5, 62, 23, 24, 146 R, 416/DIG. 5, 231 B

[56] References Cited

U.S. PATENT DOCUMENTS

| | | | |
|---|---|---|---|
| 2,716,460 | 8/1955 | Young | 416/24 |
| 4,618,313 | 10/1986 | Mosiewicz | 416/62 |

FOREIGN PATENT DOCUMENTS

| | | | |
|---|---|---|---|
| 1924299 | 2/1971 | Fed. Rep. of Germany | 416/24 |
| 909803 | 5/1946 | France | 416/24 |
| 991183 | 10/1951 | France | 416/23 |
| 252442 | 5/1926 | United Kingdom | 416/23 |
| 550227 | 1/1942 | United Kingdom | 416/23 |

*Primary Examiner*—Edward K. Look
*Assistant Examiner*—James A. Larson
*Attorney, Agent, or Firm*—Robert J. Edwards; Michael L. Hoelter

[57] ABSTRACT

A fan blade comprising a body having a tip end and an in-board end is configured with first and second fin portions that extend along the trailing edge of the body of the fan blade. The first fin portion extends from the in-board end of the fan blade along the trailing edge toward the tip end, while the second fin portion extends from the tip end of the fan blade along the trailing edge toward the in-board end. Both the first and second fin portions extend outwardly from the trailing edge of the body at an angle to this trailing edge. Generally a slot or gap would exist between these first and second fin portions and both such fin portions would have a tapered width which narrows in the direction of the tip end. Additionally, the width of the first fin portion would be greater than the width of the second fin portion. Furthermore, the two fin portions may or may not be coplanar in order to optimize air flow.

12 Claims, 1 Drawing Sheet

EXTRUDED ALUMINUM FAN BLADE

FIELD OF THE INVENTION

The present invention relates in general to fan blades and in particular to a new and useful multiple piece fin for a fan blade.

BACKGROUND OF THE INVENTION

It is known that a blade having a "twist" thereto provides more lift (and hence an increase in the displacement of air) than blades which are not so "twisted" or are uniform and consistent along their length.

The economical manner to produce aluminum fan blades is by the extrusion process, however, the extrusion process generally only produces non-twisted blades. To impart a uniform angular twist in an extruded airfoil requires mechanically yielding the airfoil in a secondary process. This secondary process is costly and it often produces inconsistent results. Consequently, it is desirable to combine the performance of the "twisted" blades with the economics of the uniform blades to achieve a high performance blade at a relatively low cost.

One attempt to achieve this result is disclosed in U.S. Pat. No. 4,618,313 to Mosiewicz. This patent discloses an axial propeller blade comprising a single tab (32) secured along its trailing edge. This single tab is also disclosed as being inclined from the blade at an angle of from 10° to 70° so as to enhance the lift of the blade. However, the tab of Mosiewicz is planar and of uniform or consistent configuration. Consequently, there is no possibility of this tab having one configuration and/or angle at the root end of the blade and another configuration and/or angle at the tip end of the blade so as to be more consistent with "twisted" blades. There is also no likelihood of this tab conforming to the multiple planes normally found in "twisted" fan blades which cause or result in increased performance.

Presently, there is no known fan blade which utilizes a multi-piece tab or fin that is either attached to or extruded from the trailing edge of a fan blade. Thus, it is an object of the present invention to provide a multiple piece fin which is extruded or attached to the trailing edge of the fan blade. Another object of this invention is to provide a fan blade incorporating a trailing fin whose angle and/or configuration can be varied as needed along the length of the fan blade for performance optimization. It is another object of this invention to provide a fan blade which is more economical to construct than "twisted" fan blades. Yet another object of this invention is to provide a fan blade whose operating performance is comparable with or exceeds that of "twisted" fan blade. These and other objects and advantages of this invention will become obvious upon further investigation

SUMMARY OF THE INVENTION

The present invention comprises a fan blade having a multiple piece fin either attached or extruded to a trailing end of the body of a fan blade. The two-piece fin comprises an end fin extending from an in-board end of the fan blade and a tip fin extending inwardly from the tip of the fan blade toward the in-board end. Both the end fin and the tip fin are spaced a distance from each other and are in alignment on the trailing edge of the body of the fan blade. Furthermore, the end fin and the tip fin both have a narrowing or a tapered width with the width of the end fin being greater than the width of the tip fin.

DESCRIPTION OF THe PREFERRED EMBODIMENT

Figure 1:
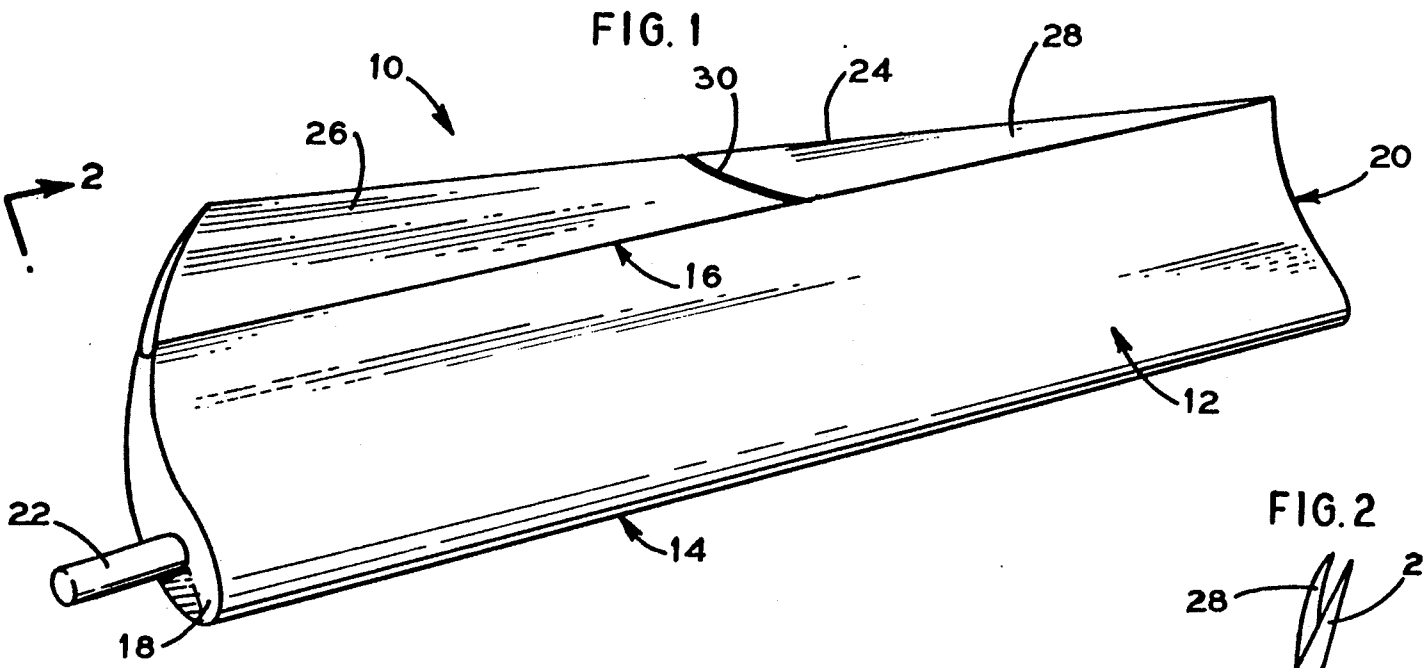
FIG. 1 is a perspective view of the present invention wherein the fin is extruded from the trailing edge of the blade.
Figure 2:
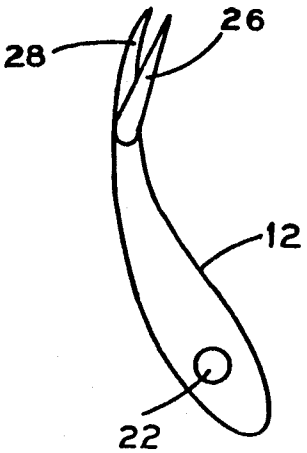
FIG. 2 is a sectional view taken along lines 2—2 of FIG. 1 illustrating the inboard portion of the fin pitched at a greater angle with respect to the blade than the outboard portion of the fin.
Figure 3:
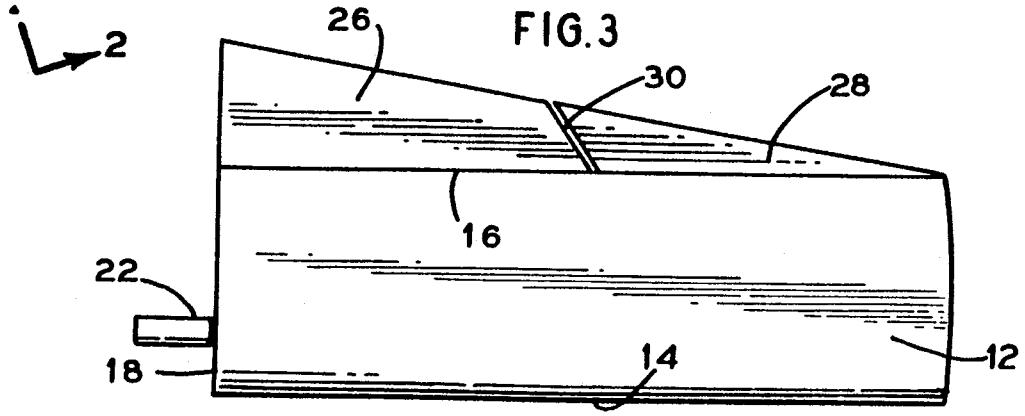
FIG. 3 is a front view of the present invention illustrating the configuration wherein both fin portions are in alignment with each other.

FIGS. 1-3 illustrate a fan blade, generally designated 10, comprising a body 12 having a leading edge 14 and a trailing edge 16. Body 12 has an in-board or root end 18 and an out-board or tip end 20 directly opposite in-board end 18. In-board end 18 is secured to a propeller or the like through the use of mounting means such as shaft 22 mounted to in-board end 18.

In this embodiment, fan blade 10 is configured with a two-piece fin 24 which is extruded from body 12 of fan blade 10. However, in other embodiments, fin 24 may consist of more than two pieces if need be for performance optimization. Regardless of the number of pieces desired, each such piece is, after being installed, rigidly or permanently affixed to blade 10 thereby becoming integral with blade 10.

As shown in this two-piece fin embodiment, a first fin portion 26 extends outwardly from trailing edge 16 and extends from in-board end 18 along a portion of trailing edge 16 toward tip end 20 of body 12. A corresponding second fin portion 28 extends inwardly from tip end 20 of body 12 along trailing edge 16 toward in-board end 18. Fin portions 26 and 28 can extend within the same plane and be linearly aligned with each other if such is desired (see FIG. 3). However, as illustrated in FIG. 2, it is possible for fin portions 26 and 28 to be independently aligned, or be non-linear, and they also need not extend within the same plane. Once the angular alignment of first fin portion 26 with respect to trailing edge 16 is calculated or determined, this first fin portion 26 is then permanently affixed or extruded onto fan blade 10. Second fin portion 28 generally continues along the same curvature as its respective portion of blade 10 and once affixed, is not thereafter adjustable.

Between fin portions 26 and 28 is slot 30 which forms an obtuse angle with respect to trailing edge 16. As a result of this configuration, first fin portion 26 has a generally trapezoid shape while second fin portion 28 consists of an obtuse triangle. In other embodiments, there may be three or more fin portions along body 12 with each such portion located and aligned as needed to maximize air flow across blade 10. Fan blade 10 with fin portions 26 and 28 can be made of aluminum, metal, alloy, plastic, glass fibers or other suitable material.

FIG. 2 illustrates first and second fin portions 26 and 28 which are attached or otherwise secured to trailing edge 16 of fan blade 10. FIG. 2 also illustrates how fin portions 26 and 28 can be pitched at optimum angles to maximize air flow on inboard end 18. In this case, inboard fin portion 26 is pitched at a higher angle than outboard fin portion 28. Typically, the lower angular velocity present on axial fans near the center of the fan (i.e. inboard region) requires greater blade twist in that area to provide airflow which is uniform with or similar to that generated by the outboard portion of blade 10.

As can be expected, slot 30 is provided between these fin portions 26 and 28 which can be secured in place by welding, bonding, gluing, riveting, bolting or by other fastening means. Additionally, these fin portions 26 and 28 can be constructed of the same material as fan body 12 or these fin portions 26 and 28 can be made of a different material. Generally, fin portions 26 and 28, along with fan body 12, are constructed of aluminum. However, other materials of construction, such as resin reinforced plastic or fiberglass, or some other type of metal may be utilized as desired.

While a specific embodiment of the invention has been shown and described in detail to illustrate the application of the principles of the invention, it will be understood that the invention may be embodied otherwise without departing from such principles.

What is claimed is:

1. A fan blade comprising:

(a) a body having a tip and an end opposite said tip, said body also having a leading edge and a trailing edge between said tip and said end;

(b) non-adjustable multiple fin means rigidly affixed to said trailing edge of said body at a preset angle for directing air flow across said body, said fin means comprising at least two fin portions with a first fin portion extending at a first angle outwardly from said trailing edge along a first length of the fan blade and being integral with the fan blade and with a second fin portion extending at a second angle outwardly from said trailing edge along a second length of the fan blade and being integral with the blade, said second fin portion configured with the same curvature as said length of the fan blade.

2. The fan blade as set forth in claim 1 wherein said first and said second fin portions are separated from each other by an open slot with said first and said second angles being different.

3. The fan blade as set forth in claim 1 wherein said first fin portion extends from said end of said body to a first position on said trailing edge of said body.

4. The fan blade as set forth in claim 3 wherein said second fin portion extends from said tip of said body to a second position on said trailing edge of said body.

5. The fan blade as set forth in claim 4 wherein said first fin portion is generally configured as a trapezoid.

6. The fan blade as set forth in claim 5 wherein said second fin portion is configured as an obtuse triangle.

7. The fan blade as set forth in claim 6 wherein said first and second fin portions having a tapered width which narrows in the direction of said tip.

8. The fan blade as set forth in claim 7 wherein the tapered width of said first fin portion is larger than the tapered width of said second fin portion.

9. The fan blade as set forth in claim 8 wherein said first and second fin portions are linearly aligned.

10. The fan blade as set forth in claim 8 wherein said first and second fin portions are not linearly aligned.

11. The fan blade as set forth in claim 8 wherein said first and second fin portions are planar.

12. The fan blade as set forth in claim 8 wherein said first and second fin portions are non-planar.

* * * * *